US005564962A

United States Patent [19]

Navarrete Espinosa

[11] Patent Number: 5,564,962

[45] Date of Patent: Oct. 15, 1996

[54] MODULAR TRACK FOR TOY CARS

[75] Inventor: Ramon Navarrete Espinosa, Alicante, Spain

[73] Assignee: Mac Molto, S.A., Alicante, Spain

[21] Appl. No.: 396,664

[22] Filed: Mar. 1, 1995

[30] Foreign Application Priority Data

Aug. 19, 1994 [ES] Spain ..... 9402235 U

[51] Int. Cl.[6] ..... A63H 33/08

[52] U.S. Cl. ..... 446/128; 446/168

[58] Field of Search ..... 446/118, 128, 446/168; 273/86C, 118 R, 120 R, 275, 276

[56] References Cited

U.S. PATENT DOCUMENTS

| | | | |
|---|---|---|---|
| 2,000,808 | 5/1935 | Williams | 446/168 |
| 3,145,501 | 8/1964 | Grosser | 446/168 |
| 3,379,440 | 4/1968 | Jaffe | 273/86 C |
| 3,394,489 | 7/1968 | Martin | 446/168 |
| 3,587,190 | 6/1971 | Ashton | 446/168 |
| 3,768,810 | 10/1973 | Goldfarb et al. | 273/120 R |
| 4,045,908 | 9/1977 | Ensmann et al. . | |
| 4,713,038 | 12/1987 | Wichman et al. | 446/168 |
| 4,932,917 | 6/1990 | Klitsner | 273/86 C |
| 5,312,285 | 5/1994 | Riebe et al. | 273/86 C |
| 5,344,143 | 9/1994 | Yule | 446/128 |

FOREIGN PATENT DOCUMENTS

| | | | |
|---|---|---|---|
| 1478451 | 5/1969 | Germany | 446/168 |
| 34364 | 11/1960 | Spain . | |
| 1225394 | 3/1971 | United Kingdom . | |
| 94/26372 | 11/1994 | WIPO | 446/168 |

*Primary Examiner*—Robert A. Hafer
*Assistant Examiner*—Jeffrey D. Carlson
*Attorney, Agent, or Firm*—Darby & Darby, P.C.

[57] ABSTRACT

A modular track for toy cars allows different race tracks to be made so that small toy cars can run along them. The track includes six types of pieces which combined according to the user's imagination provide multiple possibilities of different race tracks. Three of these types of pieces are stretches of the race track, straight, curved or sloped, which include some guardrails interrupted at the end to facilitate crossings and intersections in the race track. Two other types are connection blocks between the different stretches of the race track, and the other type is an end piece for the beginning and end of the race tracks. The connections between the stretches of the race track and the connection blocks are achieved by respective cylindrical holes and projections.

16 Claims, 7 Drawing Sheets

MODULAR TRACK FOR TOY CARS

OBJECT OF THE INVENTION

As is expressed in the title of this specification, the present invention refers to a modular tract for toy cars whose purpose consists of providing the pieces needed to build toy race tracks, in an easy and versatile way, which toy cars can run along, and by means of the combination of different pieces that are coupled together by means of cylindrical projections and holes.

DESCRIPTION OF THE INVENTION

In order to achieve the above mentioned aims, the invention consists of a building toy with different pieces that allow different race tracks to be formed.

The pieces are of six types: three of them comprise different stretches of the race track. Two others comprise connection blocks between the different stretches of the race track by means of some cylindrical projections that correspond with holes existing in the stretches of the race track. The other type is an end piece for the beginning and end of the race track, that includes a small sloped stretch of the race track and two cylindrical projections for connection to the last stretch of the race track.

One of the stretches of the race track is straight and horizontal having on the sides some partitions or guardrails that are interrupted in the ends to allow intersections or crossings with other stretches of race track. The ends are provided with both pairs of cylindrical holes for coupling thereof with the projections of the connection blocks between stretches of race track.

Another one of the stretches of the race track is straight but includes a center ramp, so that its ends remain on different horizontal planes. Just like the above stretch, this stretch also includes cylindrical holes in the ends thereof, and side partitions that are interrupted in the ends of the stretch.

The other stretch of the race track is a horizontal but curved "C"-shaped one. This stretch has side partitions which in this case reach the ends of the piece. These ends include both pairs of cylindric holes. Besides, these curved stretches have four other cylindrical holes in the center part thereof which also correspond with the projections of the connection blocks.

One of the blocks has a quadrangular base and on the top it has four cylindrical projections. This type of block permits the connection between stretches of race track, since since two of the projections thereof will fit in the two holes of the end of a stretch of race track and the other two projections in the end of another stretch of race track.

The other type of blocks has a rectangular base and has at the top other cylindrical projections. This type of block, aside from normal interconnection of stretches of race track, allows crossings or intersections between the stretches of race track to be made as there are additional projections.

With all of these pieces that have been described it is possible to build a large diversity of race tracks with different curves, straight stretches, slopes and crossings; depending to a large degree on the user and permitting toy cars to run around the race tracks.

Hereinafter, to provide a better understanding of this specification and forming an integral part of the same, some figures in which the object of the invention has been represented in an illustrative and non-restrictive manner are attached hereto.

DESCRIPTION OF AN EMBODIMENT OF THE INVENTION

Figure 1:
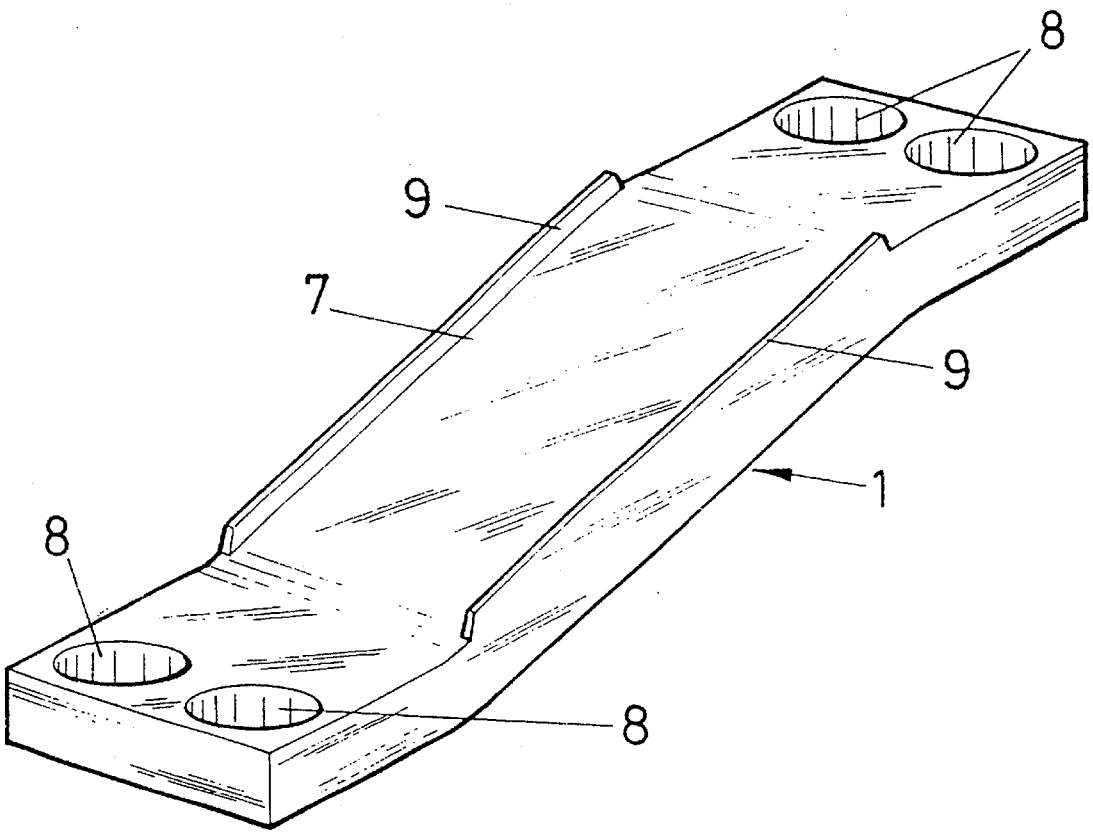
FIG. 1 represents a perspective view of a straight stretch of race track and with a ramp of those that are used in the building toy of the present invention.
Figure 2:
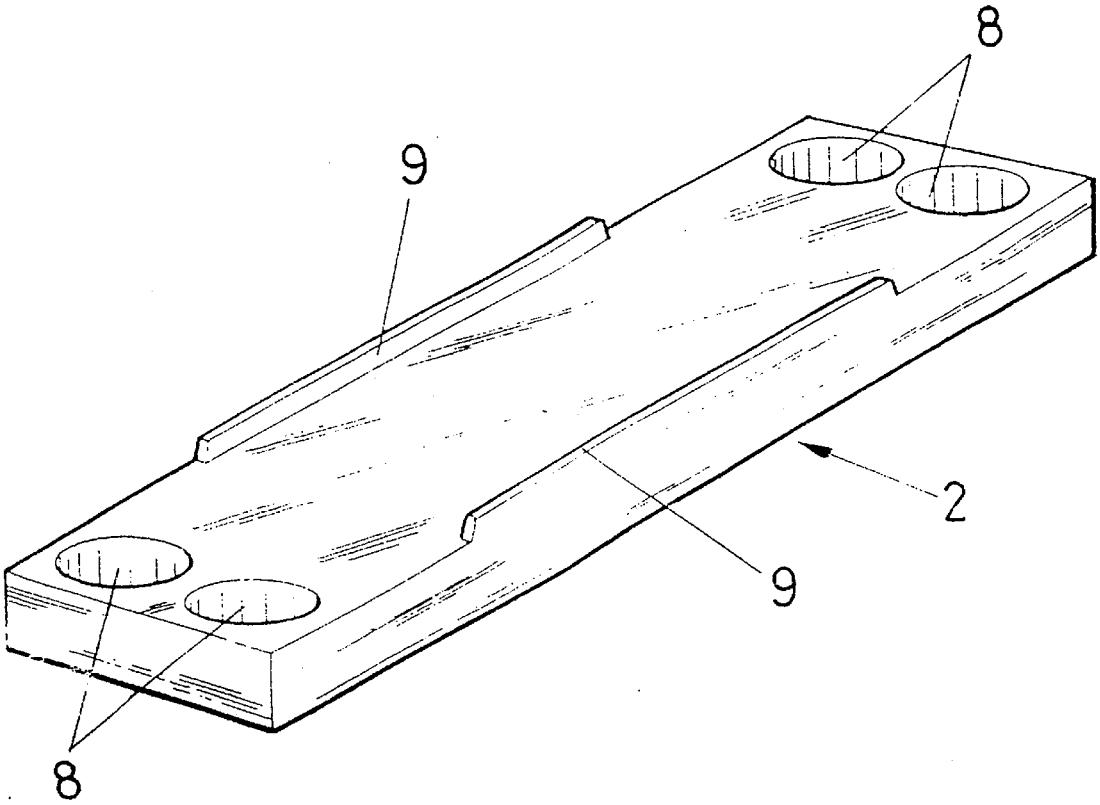
FIG. 2 represents a perspective view of a straight horizontal stretch of race track of those used in the building toy of the present invention.
Figure 3:
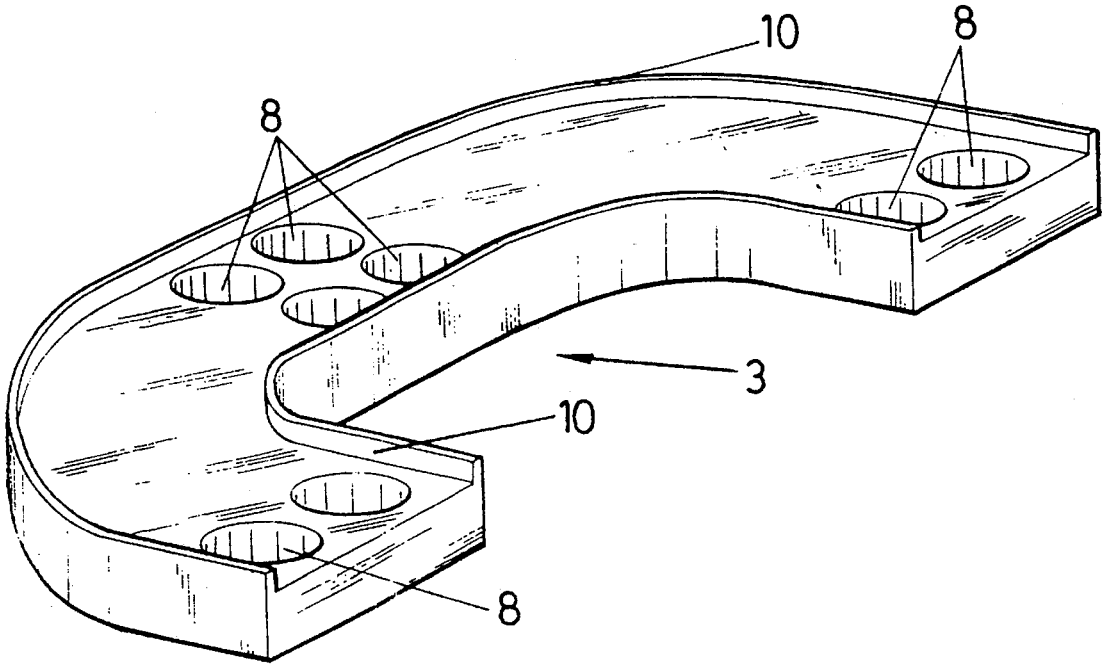
FIG. 3 represents a perspective view of a curved stretch of race track of those used in the building toy of the invention.
Figure 4:
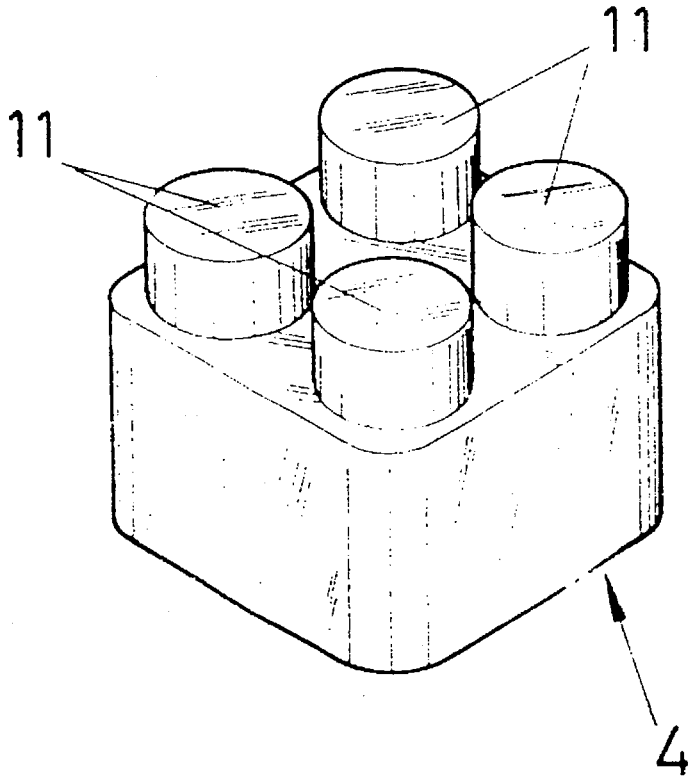
FIG. 4 represents a perspective view of a connection block between stretches of race track of those with a quadrangular base and used in the building toy of the invention.
Figure 5:
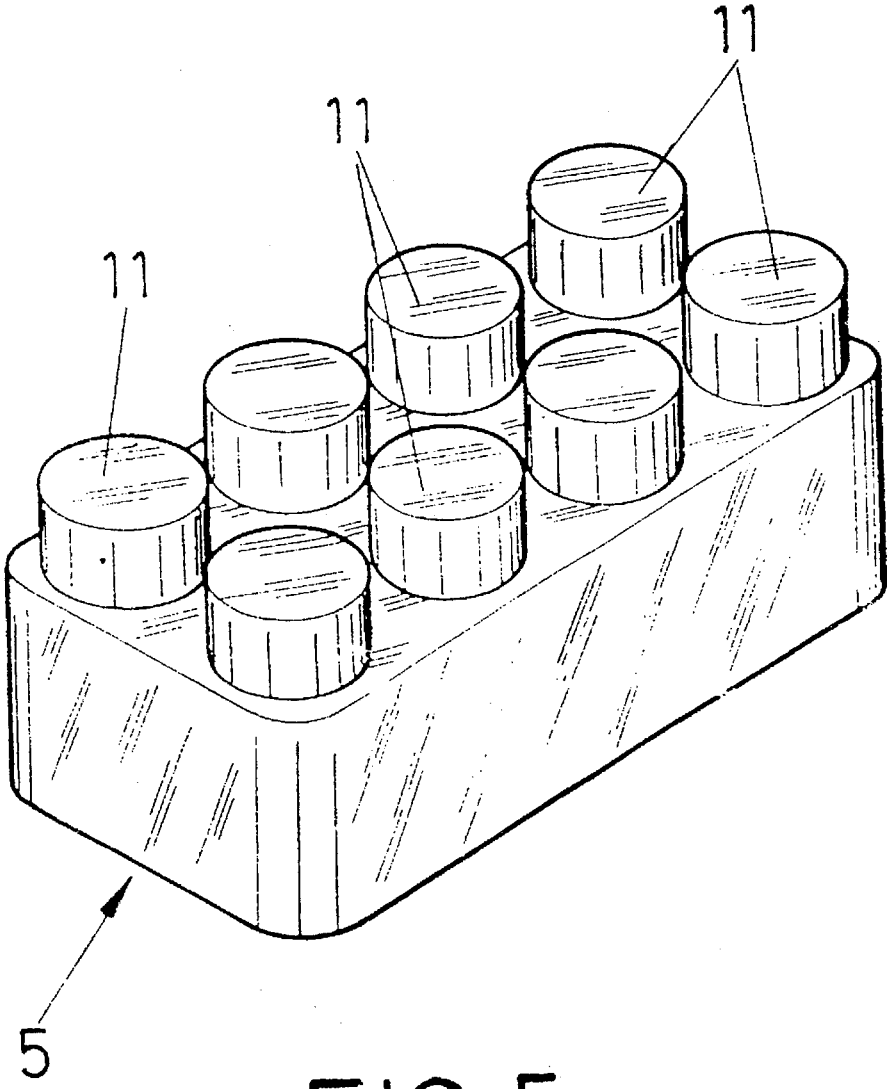
FIG. 5 represents a perspective view of a connection block between stretches of race track of those with a rectangular base and used in the building toy of the invention.
Figure 6:
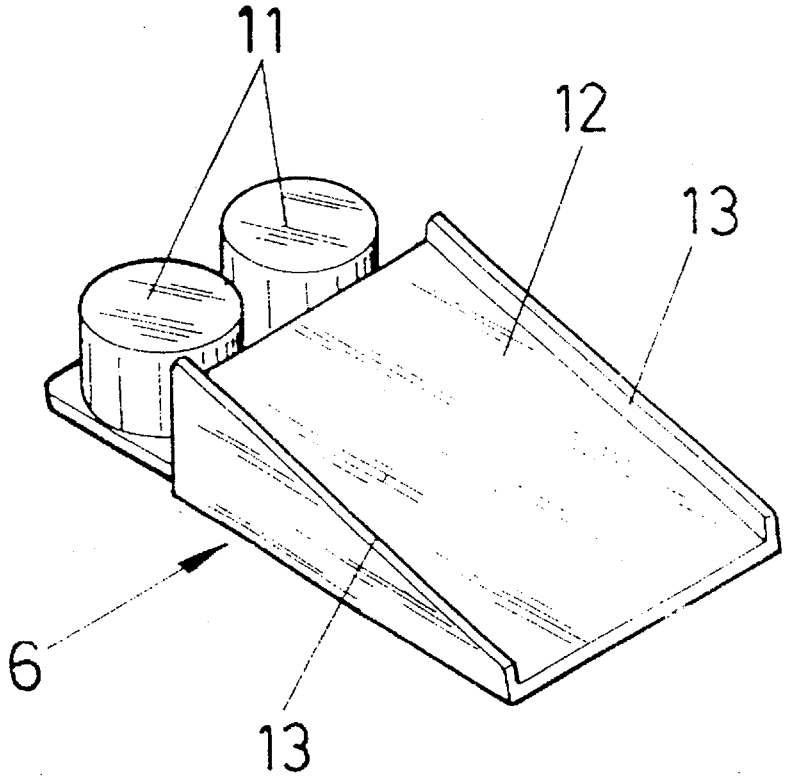
FIG. 6 represents a perspective view of an end piece of those used in the building toy of the present invention.

A description is made hereinafter of an embodiment of the invention, making reference to the numbers used in the figures.

Hence, the building toy of this embodiment has six different pieces (1 to 6) which we are going to describe.

Piece (1) is a straight stretch of race track that includes a ramp (7) in its center part. The ends of this piece (1) have cylindrical holes (8) and on the sides of the center part there are some partitions or guardrails (9.)

Piece (2) is a straight horizontal stretch of race track and just like the previous one it includes cylindrical holes (8) in the ends, and side partitions (9) in the center part thereof.

Piece (3) is a curved "C"-shaped stretch of race track that includes cylindrical holes (8) in its ends and in its center part. This piece (3) includes side partitions (10) that reach its ends.

Piece (4) is a connection block between stretches of race track that includes four cylindrical projections (11) of dimensions corresponding to the cylindric holes (8), in such a way that insertion thereof in them is made easier for the connection of the different stretches of race track (1) , (2) or (3.)

Piece (5) is another connection block between stretches of race track but it has eight cylindrical projections (11) placed in two rows of four. This also allows aside from connection between stretches of race track, crossings or intersections as shown in FIG. 7 to be made.

Piece (6) is an end piece for the beginning and end of the race tracks that are built. Piece (6) includes a small sloped stretch of race track (12) with its corresponding side partitions (13) and two cylindrical projections (11) to permit connection thereof to pieces (1), (2) and (3.)

The bottom part of all the pieces (1) to (6) have recesses that permit material to be saved and which facilitates some connections, as in the cases of crossings or intersections between stretches of race track.

Figure 7:
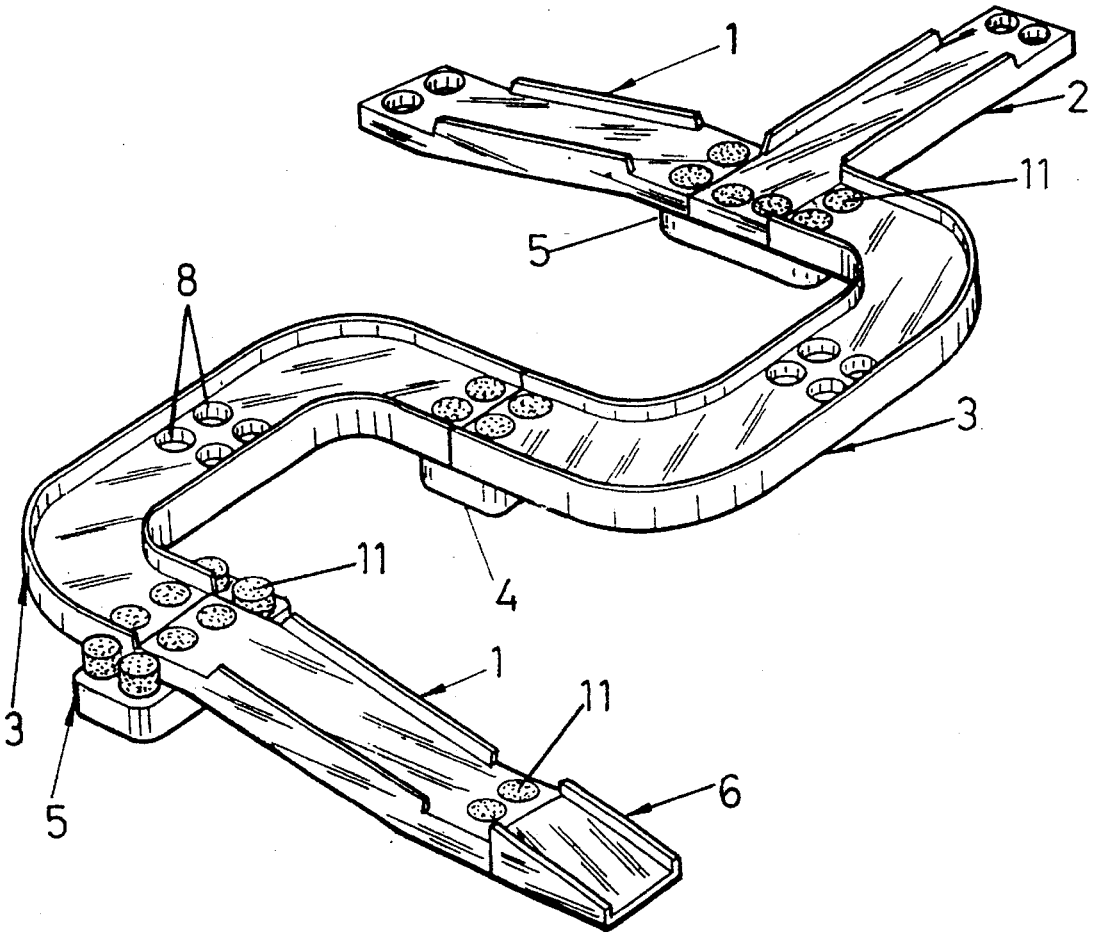
FIG. 7 represents a perspective view of a race track built with the pieces of the building toy of the present invention.

With all of these pieces (1) to (6) different race tracks can be made so that toy cars run along them, such as the race track shown in FIG. 7 for example.

I claim:

1. A modular track for my cars comprising:

a plurality of stretches of race track; and a plurality of connection blocks, wherein each of said plurality of stretches having a first end, a second end, a first side, a second side, a top surface and a bottom surface; each of said plurality of stretches having two through holes being disposed at each of said first end and said second end, said through holes extending from said top surface to said bottom surface and each of said through holes having a first end and a second end;

each said connection blocks having a top surface and a bottom surface, said top surface of said connection block defining at least four cylindrical projections, at least one of said plurality of stretches is straight and horizontal, said first side and said second side of said stretches are provided with partitions that are interrupted at said first end and said second end of said stretches;

wherein the height of said cylindrical projections is substantially the same as the distance from said first end to said second end of said through hole, and wherein the shape and dimension of the cross section of said projections arc complementary in shape and size to said through holes;

wherein said plurality of stretches arc connected end-to-end by means of said connection blocks.

2. The modular track for toy cars according to claim 1, wherein at least one of said stretches is straight and has a center ramp.

3. The modular track for toy cars according to claim 1, wherein at least one of said stretches is horizontal and has a curved "C"-shaped.

4. The modular track for toy cars according to claim 3, wherein said first side and said second side of said plurality of stretches are provided with partitions that reach said first end and said second end of said stretch.

5. The modular track for toy cars according to claim 3, wherein said top surface of said plurality of stretches has in its center part four through holes disposed quadrangularly with respect to each other.

6. The modular track for toy cars according to claim 1, wherein said at least four cylindrical projections of said at least one of said connection blocks are disposed quadrangularly with respect to each other.

7. The modular track for toy cars according to claim 1, wherein said at least four cylindrical projections of said at least one of said connection blocks comprise eight cylindrical projections disposed quadrangularly with respect to each other in two rows of four.

8. The modular track for toy cm according to claim 1, further comprising a piece for one of the beginning and the end of the race track, said piece having a small sloped stretch of track and two cylindrical projections, said two cylindrical projections of said piece connectable to one of a first and a last stretch of the race track.

9. A modular track for toy cars comprising:

a plurality of stretches of race track; and a plurality of connection blocks, wherein each of said plurality of stretches having a first end, a second end, a first side, a second side, a top surface and a bottom surface; each of said plurality of stretches having two through holes being disposed at each of said first end and said second end, said through holes extending from said top surface to said bottom surface and each of said through holes having a first end and a second end;

each said connection block having a top surface,and a bottom surface, said top surface of said connection block defining at least four cylindrical projections, at least one of said stretches is straight and has a center ramp, wherein said first side and said second side of said plurality of stretches arc provided with partitions that are interrupted at said first end and said second end of said stretches;

wherein the height of said cylindrical projections is substantially the same as the distance from said first end to said second end of said through hole, and wherein the shape and dimension of the cross section of said projections are complementary in shape and size to said through holes;

wherein said plurality of stretches are connected end-to-end by means of said connection blocks.

10. The modular track for toy cars according to claim 9, wherein at least one of said stretches is straight and horizontal.

11. The modular track for toy cars according to claim 9, wherein at least one of said stretches is horizontal and has a curved "C"-shaped.

12. The modular track for toy cars according to claim 11, wherein said first side and said second side of said plurality of stretches are provided with partitions that reach said first end and said second end of said stretches.

13. The modular track for toy cars according to claim 11, wherein said top surface of said plurality of stretches has in its center part four through holes disposed quadrangularly with respect to each other.

14. The modular track for toy cars according to claim 9, wherein said at least four cylindrical projections of said at least one of said connection blocks are disposed quadrangularly with respect to each other.

15. The modular track for toy cars according to claim 9, wherein said at least four cylindrical projections of said at least one of said connection blocks comprise eight cylindrical projections disposed quadrangularly with respect to each other in two rows of four.

16. The modular track for toy cars according to claim 9, further comprising a piece for one of the beginning and the end of the race track, said piece having a small sloped stretch of track and two cylindrical projections, said two cylindrical projections of said piece connectable to one of a first and a last stretch of the race track.

* * * * *